US012599806B2

(12) United States Patent
Casagrande

(10) Patent No.: US 12,599,806 B2
(45) Date of Patent: Apr. 14, 2026

(54) EXERCISE MACHINE

(71) Applicant: TECHNOGYM S.P.A., Cesena (IT)

(72) Inventor: Simone Casagrande, Cesena (IT)

(73) Assignee: Technogym S.p.A., Cesena FC (IT)

( * ) Notice: Subject to any disclaimer, the term of this patent is extended or adjusted under 35 U.S.C. 154(b) by 201 days.

(21) Appl. No.: 18/069,134

(22) Filed: Dec. 20, 2022

(65) Prior Publication Data

US 2023/0191187 A1 Jun. 22, 2023

(30) Foreign Application Priority Data

Dec. 22, 2021 (IT) ..... 102021000032231

(51) Int. Cl.
*A63B 21/00* (2006.01)
*A63B 24/00* (2006.01)
*A63B 71/06* (2006.01)

(52) U.S. Cl.
CPC ..... *A63B 21/153* (2013.01); *A63B 21/4035* (2015.10); *A63B 24/0062* (2013.01);
(Continued)

(58) Field of Classification Search
CPC ..... A63B 21/153; A63B 21/4035; A63B 21/4043; A63B 21/0059; A63B 21/154; A63B 24/0062; A63B 24/0087; A63B 17/02; A63B 2220/833; A63B 2220/10; A63B 2220/803; A63B 2220/805; A63B 2220/806; A63B 2220/807;
(Continued)

(56) References Cited

U.S. PATENT DOCUMENTS 7,874,965 B2 * 1/2011 Alessandri ..... A63B 21/154 482/138
9,539,458 B1 1/2017 Ross
(Continued)

FOREIGN PATENT DOCUMENTS

EP 1 790 389 A2 5/2007
EP 3 202 465 A1 8/2017
WO WO 2020/152728 A1 7/2020

OTHER PUBLICATIONS

Italian Search Report received in Italian Application No. 102021000032231 dated Aug. 20, 2022 in 9 pages.

*Primary Examiner* — Megan Anderson
*Assistant Examiner* — Jonathan A Dicuia
(74) *Attorney, Agent, or Firm* — Knobbe, Martens, Olson & Bear, LLP

(57) ABSTRACT

The present disclosure relates to an exercise machine for performing a gymnastic exercise, comprising a first exercise device, in turn comprising at least one first cable, and at least one first handle, coupled to said first cable, to allow a user to perform a gymnastic exercise, and a second exercise device, in turn comprising at least one second cable, and at least one second handle, coupled to said second cable, to allow the user to perform a gymnastic exercise, said exercise machine further comprises a first actuator, connected to said first cable, for exerting a drive or resistant torque on said first cable, a second actuator, connected to said second cable, for exerting a drive or resistant torque on said second cable, and a logic control unit, connected to said first actuator and said second actuator, for adjusting said drive or resistant torque.

20 Claims, 4 Drawing Sheets

(52) U.S. Cl.
CPC .. *A63B 71/0622* (2013.01); *A63B 2024/0093* (2013.01); *A63B 2220/833* (2013.01)

(58) Field of Classification Search
CPC ..... A63B 71/0622; A63B 71/0619; A63B 2071/065; A63B 2071/063; A63B 23/03541; A63B 225/105; A63B 225/50
See application file for complete search history.

(56) References Cited

U.S. PATENT DOCUMENTS

| | | | | |
|---|---|---|---|---|
| 11,541,264 | B1 * | 1/2023 | Mallard | A63B 21/169 |
| 11,766,584 | B2 * | 9/2023 | Chiavegato | A63B 21/156 482/4 |
| 2009/0312162 | A1 * | 12/2009 | Maiaro | A63B 21/078 482/104 |
| 2014/0100491 | A1 | 4/2014 | Hu et al. | |
| 2020/0047054 | A1 * | 2/2020 | Ward | G16H 40/67 |
| 2021/0394011 | A1 * | 12/2021 | Neuhaus | A63B 71/0622 |

* cited by examiner

EXERCISE MACHINE

CROSS-REFERENCE TO RELATED APPLICATIONS

This application claims priority to Italian Patent Application No. 102021000032231, filed on Dec. 22, 2021, the contents of which are incorporated herein by reference in its entirety.

TECHNICAL FIELD

The present disclosure relates to an improved exercise machine, which is in particular equipped with a recall device for generating a resistant force.

More specifically, the disclosure relates to a machine of the aforesaid type, designed and made in particular to be installed indifferently in gyms or in domestic environments, but which can be used to perform any exercise and in any environment, wherein a resistant force is generated on the cables.

Hereinafter, this specification will be addressed to a machine for domestic use, but the same should not be considered limited to this specific use.

BACKGROUND

As is known, there are currently exercise machines wherein a user acts on a resistant member, by means of a gripping member associated with a flexible cable.

In such machines, the gripping member, or handle, makes it possible to perform free movements in the space.

Usually, the cable is wound around a plurality of pulleys in order to define a closed loop path, which is more or less complex according to the provided number of gripping members and load units.

In these machines, defined as "closed loop machines", the handle is arranged along the cable path and can be fixed to the cable at both its ends, or it can be arranged sliding on the cable.

However, it is also possible that the cables define an open loop path, in machines defined as "open loop machines", wherein the cable has one end which wraps around a plurality of pulleys and a free end to which the handle is fixed.

In known exercise machines, the resistant member can be of the gravitational, elastic or electric type, and exchanges work with the user through an interface means, such as for example a gripping member or a handle.

In machines with resistant organs of the gravitational type, the resistant force exerted by the resistant members is constant while performing gymnastic exercises.

These solutions are the impossibility of varying the resistant force as desired while performing an exercise.

In the case of resistant members of the electromagnetic type, such as for example in the case of an electric motor, the torque exerted by the motor connected to the cables is adjusted, thus varying the resistant force which opposes the user's movement.

In known machines, the cables are connected to the resistant member via a differential. A drawback of this solution is the interdependence of the resistance perceived on the cables by the user, as they are connected to the same resistant member.

SUMMARY

Therefore, the aim of some embodiments of the present disclosure is to provide an exercise machine of the aforesaid type wherein the resistance to the gymnastic exercise performance is variable while using it.

A further aim of some embodiments of the present disclosure is to provide an exercise machine wherein it is possible to adjust the exerted resistance, in different ways of use.

Therefore, an object of some embodiments of the present disclosure is an exercise machine for performing a gymnastic exercise, comprising a first exercise device, comprising in turn at least one first cable, and at least one first handle, coupled to said first cable, to allow a user to perform a gymnastic exercise, and a second exercise device, comprising in turn at least one second cable, and at least one second handle, coupled to said second cable, to allow the user to perform a gymnastic exercise, comprising a first actuator, connected to said first cable, for exerting a drive or resistant torque on said first cable, a second actuator, connected to said second cable, for exerting a drive or resistant torque on said second cable, and a logic control unit, connected to said first actuator and to said second actuator, to adjust said drive or resistant torque.

According to some of the embodiments of the disclosure, said machine may comprise a first winding drum, connected to said first actuator, and on which said first cable is wound, and a second winding drum, connected to said second actuator, and on which said second cable is wound.

According to the disclosure, training programmes comprising one or more gymnastic exercises are stored in said logic control unit.

According to the disclosure, said machine may comprise an interface device, connected to said logic control unit, to display information concerning the gymnastic exercise performed by the user.

According to the disclosure, said interface device comprises a first section, for displaying data concerning the gymnastic exercise performed using said first exercise device, and a second section, for displaying data concerning the gymnastic exercise performed using said second exercise device.

According to the disclosure, said machine may comprise a positioning device connected to said logic control unit, capable of detecting the user's positioning in the proximity of said exercise machine and/or detecting the winding/unwinding of said first and second cable and sending corresponding data to said logic control unit.

According to the disclosure, said logic control unit can receive said data from said positioning device and can provide feedback of the visual or acoustic or tactile type to the user, corresponding to said data.

According to the disclosure, said positioning device is arranged on said frame to detect the user's position and/or movement in the proximity of the exercise machine, while performing the gymnastic exercise.

According to the disclosure, said detection device is a sensor such as a camera or video camera.

According to the disclosure, said positioning device is arranged on said first and/or second actuator, to detect the winding and/or unwinding status, relative to an initial reference position, of said first cable and said second cable, respectively.

According to the disclosure, said positioning device is an angular position transducer, or encoder, of the magnetic, capacitive or inductive, potentiometric or optical type.

According to the disclosure, said positioning device comprises a first positioning device arranged on said frame and a second positioning device arranged on said first actuator and/or said second actuator.

According to the disclosure, said logic control unit comprises a connection unit for being connectable to remote devices such as smartphones, tablets or cloud, from which it receives parameters concerning gymnastic exercises and/or training programmes.

According to the disclosure, said machine may comprise at least one camera, to detect the user's movements while performing the gymnastic exercise.

According to the disclosure, said first exercise device comprises a first pair of arms, for supporting said first cable, said second exercise device comprises a second pair of arms, for supporting said second cable, and said first pair of arms and said second pair of arms can change independently from a position of use, wherein a user can perform a gymnastic exercise, to a rest position, wherein said exercise machine has reduced overall dimensions.

According to the disclosure, said machine may comprise a locking/unlocking device, to lock said first pairs of arms and said second pair of arms in said use position and/or in said rest position.

According to the disclosure, said locking/unlocking device comprises a pedal, to allow the change of said first pair of arms and said second pair of arms from said use position to said rest position and vice versa, and a plurality of pins, to lock said first pair of arms and said second pair of arms in said use position and said rest position.

According to the disclosure, said first exercise device comprises a coupling mechanism, said first pair of arms comprises an upper arm and a lower arm, coupled together by means of said coupling mechanism, for being in stable equilibrium in any position they may assume between said use position and said rest position, said second exercise device comprises a second coupling mechanism, said second pair of arms comprises a second upper arm and a second lower arm, coupled together by means of said second coupling mechanism, for being in stable equilibrium in any position they can assume between said use position and said rest position.

A further object of some embodiments of the present disclosure is a method for operating an exercise machine which may comprise the following steps:

a. receiving data concerning the configuration of said exercise machine;
b. processing said data received in said step a. for determining the configuration of said exercise machine;
c. activating or deactivating, on the basis of said data processed in said step b., said first actuator of said first exercise device and/or said second actuator of said second exercise device.

According to the disclosure, said method may comprise, after said step c., the following step:

d. displaying information concerning the gymnastic exercise performance with said first exercise device and/or said second exercise device, activated in said step c.

BRIEF DESCRIPTION OF THE DRAWINGS

The disclosure will now be described for illustrative but not limitative purposes, according to its preferred embodiments, with particular reference to the figures of the enclosed drawings, wherein.

DETAILED DESCRIPTION

Figure 1:
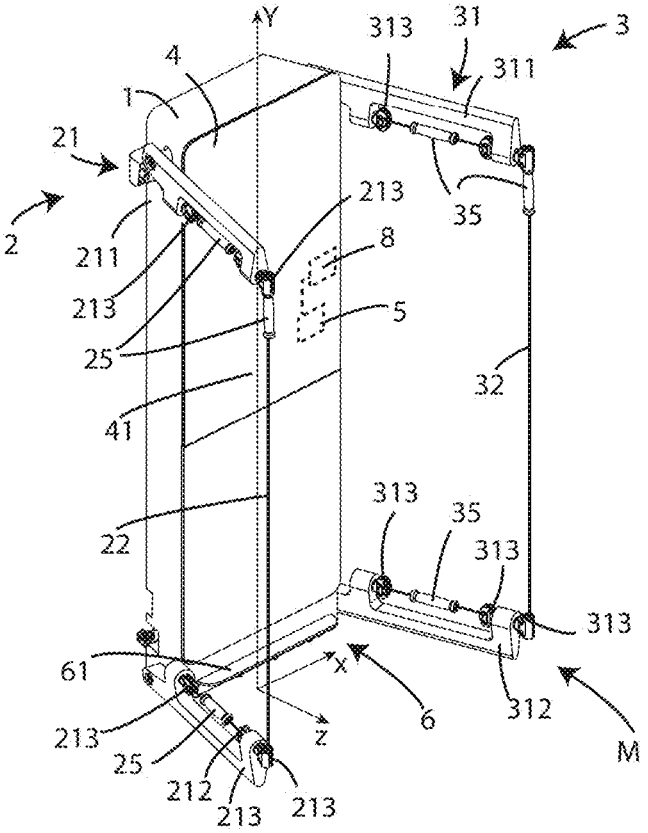
FIG. 1 shows an axonometric view of the exercise machine, object of the disclosure, covered by a covering carter, in a first configuration.
Figure 2:
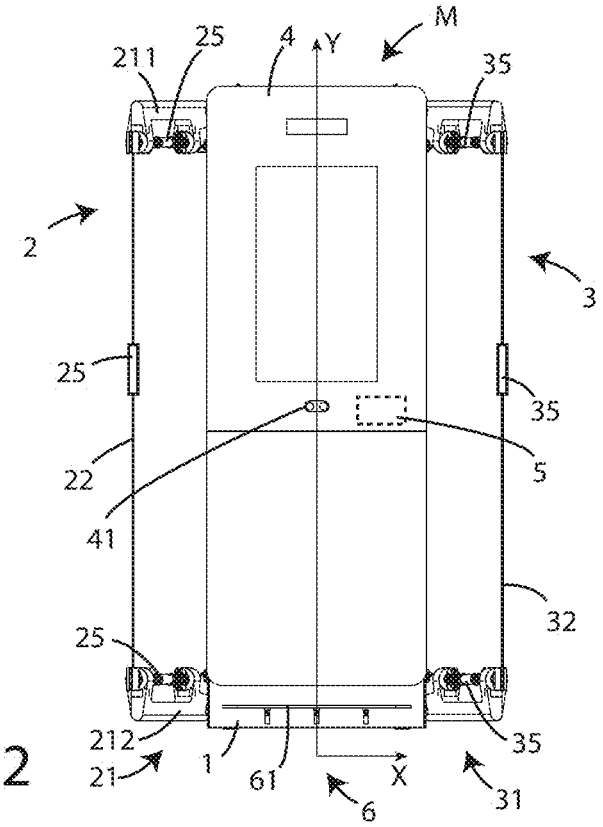
FIG. 2 shows a front view of the exercise machine of FIG. 1, in the first configuration.
Figure 3:
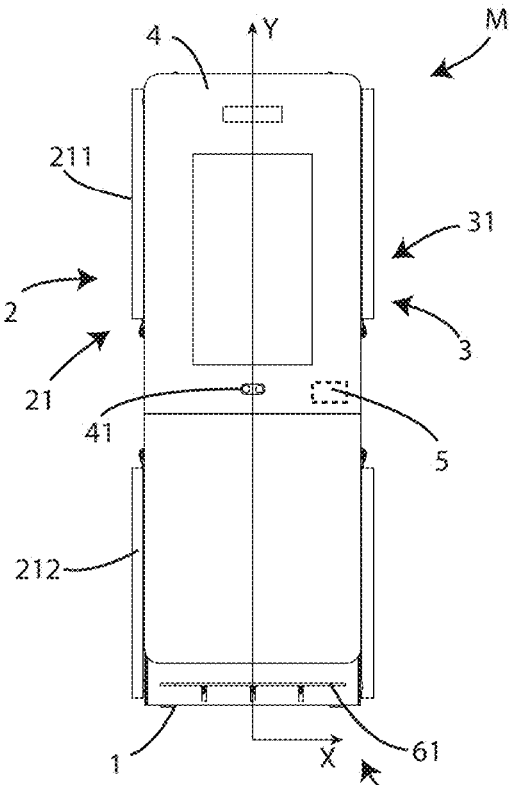
FIG. 3 shows a front view of the machine of FIG. 1, in a second configuration.

In the various figures, similar parts will be indicated by the same reference numbers.

Referring to the enclosed figures, it is possible to observe an improved exercise machine M, object of the disclosure.

The exercise machine M comprises a frame 1, a first exercise device 2 and a second exercise device 3, an interface device 4 and a logic control unit 5.

The frame 1 has a substantially flat shape which lies in a vertical XY plane and can be secured to a support structure, such as for example a wall, or it can have its own base to guarantee its stability during use.

The first exercise device 2 is coupled to the frame 1 and comprises a first pair of arms 21, a first cable 22, a first winding drum 23, a first actuator 24 and at least one first handle 25.

The first pair of arms 21 is coupled to the frame 1 and comprises an upper arm 211, a lower arm 212 and a plurality of transmission elements 213, which guide the sliding of said first cable 22.

Said at least one first handle 25 is arranged on said first cable 22 and can be grasped by a user to perform a gymnastic exercise.

In particular, the first handle 25 is free to slide along the first cable 22, when a force parallel to the first cable 22 is applied thereto, and move integrally with the first cable 22 itself, when a force not parallel to the first cable 22 is applied by the user.

Said plurality of transmission elements 213 is coupled to said upper arm 211 and to said lower arm 212. In particular, the transmission elements 213 are rotatably coupled to said upper arm 211 and to said lower arm 212, for guiding the sliding of said first cable 22 as it is moved in any arbitrary direction in the space.

Each transmission element of said plurality of transmission elements 213 comprises a fixed portion or bracket, fixed to an arm, and a movable portion comprising in turn two transmission pulleys rotatable relative to the bracket.

Pairs of said plurality of transmission elements 213 also define the portions of said first cable 22 on which said at least one first handle 25 can slide.

The first cable 22 can therefore slide freely relative to the first pair of arms 21, guided by said transmission elements 213, allowing the user to pull the first cable 22 in different directions to perform different exercises.

Without departing from the scope of protection of the present disclosure, the first pair of arms 21 may be rotatably coupled to said frame 1, so as to move to different positions.

Referring to FIGS. 1-6, the upper arm 211 and the lower arm 212 are capable of rotating to change from a use position, wherein they are substantially parallel to a horizontal Z axis, perpendicular to said vertical XY plane, to a rest position, wherein they are substantially parallel to the vertical XY plane.

Figure 9:
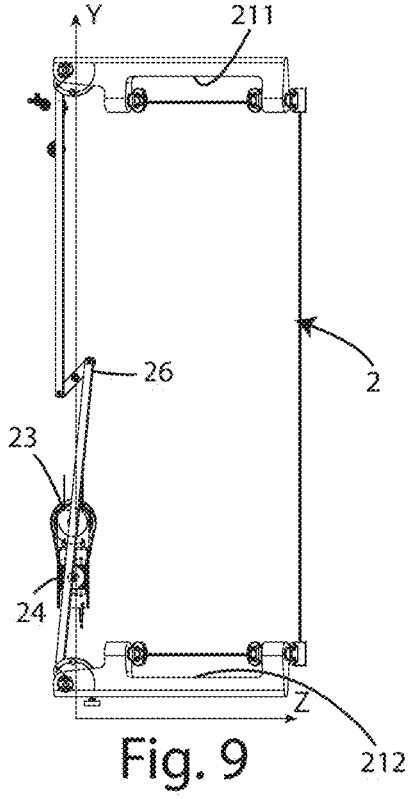
FIG. 9 shows a side view of some components of the exercise machine shown in FIG. 1, in the first configuration.

Referring to FIG. 9, the first exercise device 2 further comprises a coupling mechanism 26, coupled to the first pair of arms 21. The coupling mechanism 26 moves said upper arm 211 and said lower arm 212 integrally, to change from the rest position to the use position and vice versa.

Said coupling mechanism 26 comprises a plurality of mutually articulated levers which allow the first pair of arms 21 to be in a balanced condition at any point between the rest position and the use position. In detail, the weight of the upper arm 211 is counterbalanced by the lower one 212.

Figure 4:
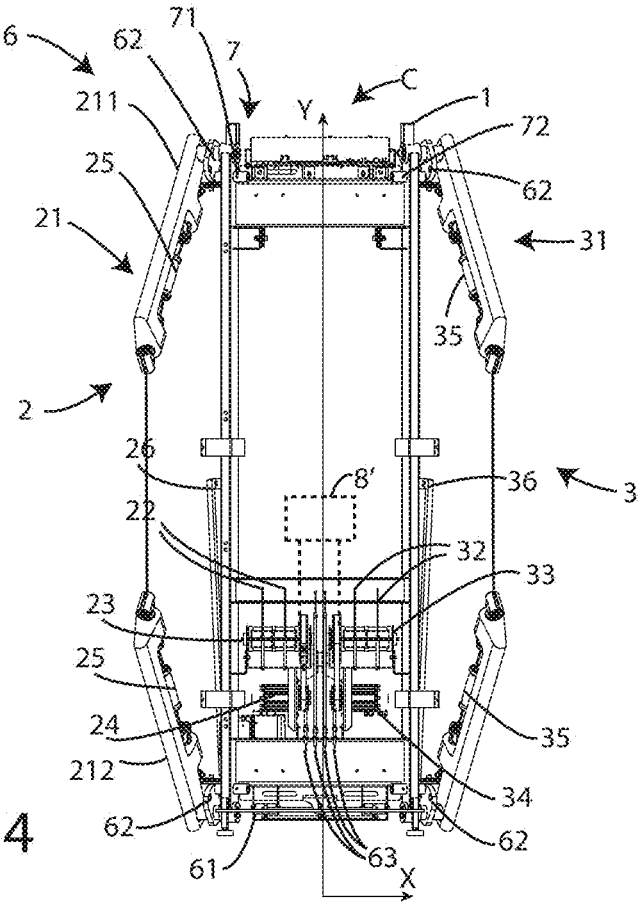
FIG. 4 shows a front view of the exercise machine of FIG. 1, without the covering carter, while changing between the first configuration and the second configuration or vice versa.
Figure 5:
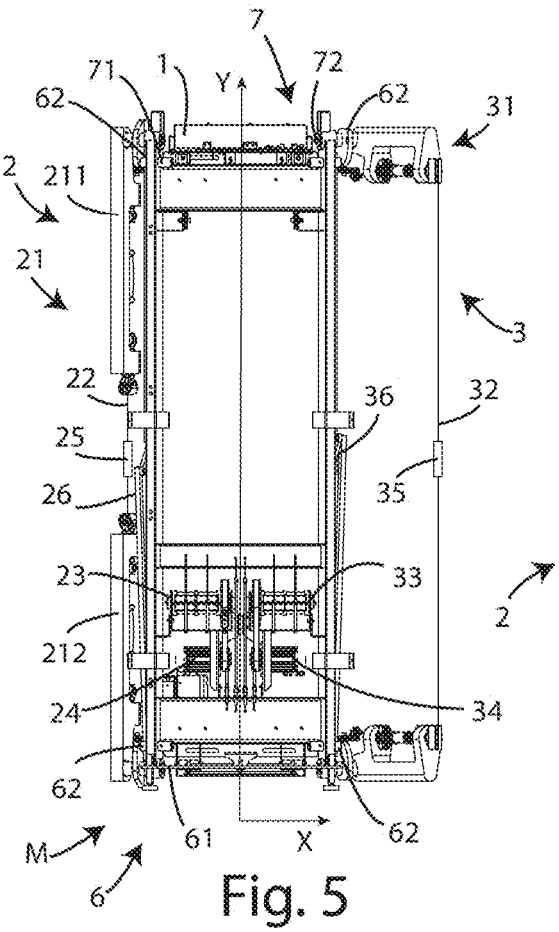
FIG. 5 shows a front view of the machine shown in FIG. 4, in a third configuration.

Referring to FIG. 4, the first cable 22 is guided by said plurality of transmission elements 213 and has two ends, both wound on said first winding drum 23.

The first winding drum 23 is in turn connected to the first actuator 24, either directly or via a mechanical drive, for example a belt drive.

The second exercise device 3 is arranged on the frame 1 secularly to said first exercise device 2, relative to a vertical Y axis.

The second exercise device 3 is symmetrical and entirely similar to the first exercise device 2, and comprises a second pair of arms 31, a second cable 32, a second winding drum 33, a second actuator 34, at least one second handle 35 and a second coupling mechanism 36. Said second pair of arms 31 in turn comprises a second upper arm 311, a second lower arm 312 and a second plurality of transmission elements 313.

Said first actuator 24 and said second actuator 34 may be for example brushless motors or other types of electric motor.

Said exercise machine M may assume a first configuration, wherein said first pair of arms 21 and said second pair of arms 31 are both in the use position.

Said exercise machine M may also assume a second configuration, wherein said first pair of arms 21 and said second pair of arms 31 are both in the rest position.

Finally, said exercise machine M may assume a third configuration, wherein said first pair of arms 21 is in the use position and said second pair of arms 31 is in the rest position, or vice versa.

Figure 6:
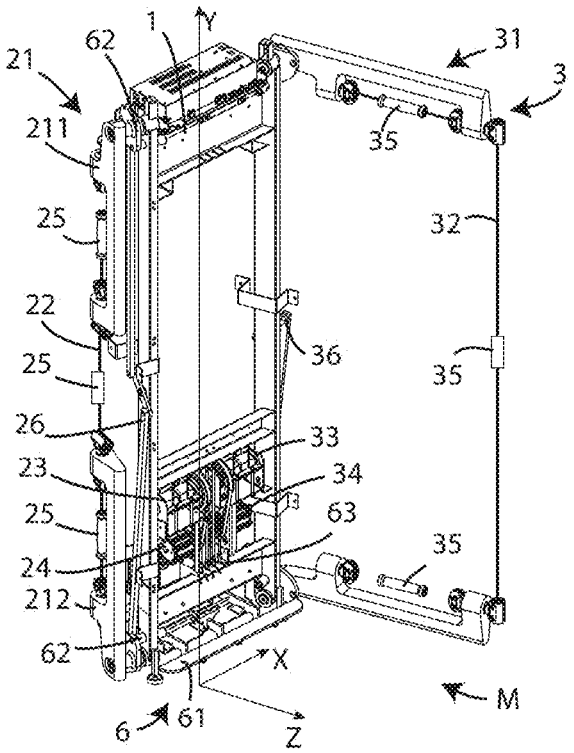
FIG. 6 shows an axonometric view of the machine in the configuration shown in FIG. 5.
Figure 7:
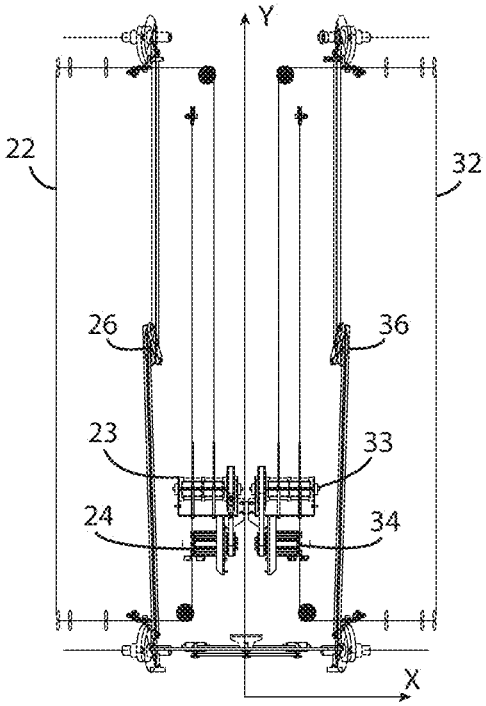
FIG. 7 shows a front view of some components of the exercise machine of FIG. 1, in the first configuration.
Figure 8:
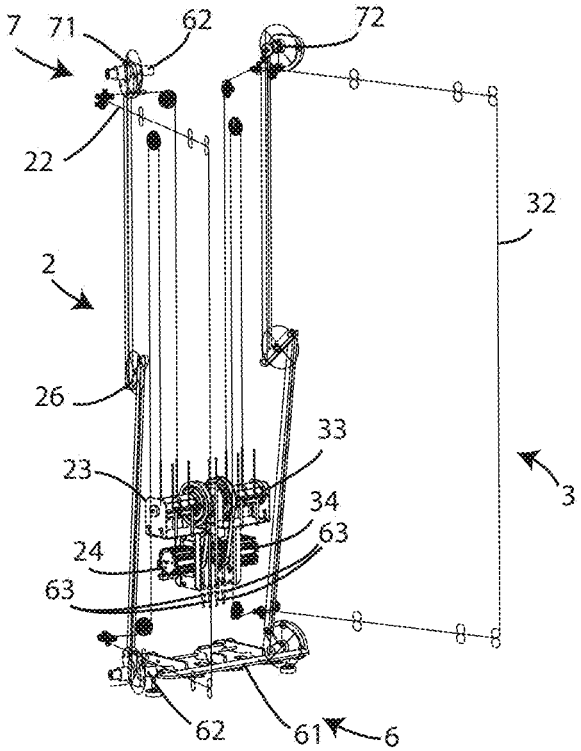
FIG. 8 shows an axonometric view of the components shown in FIG. 7.
Figure 10:
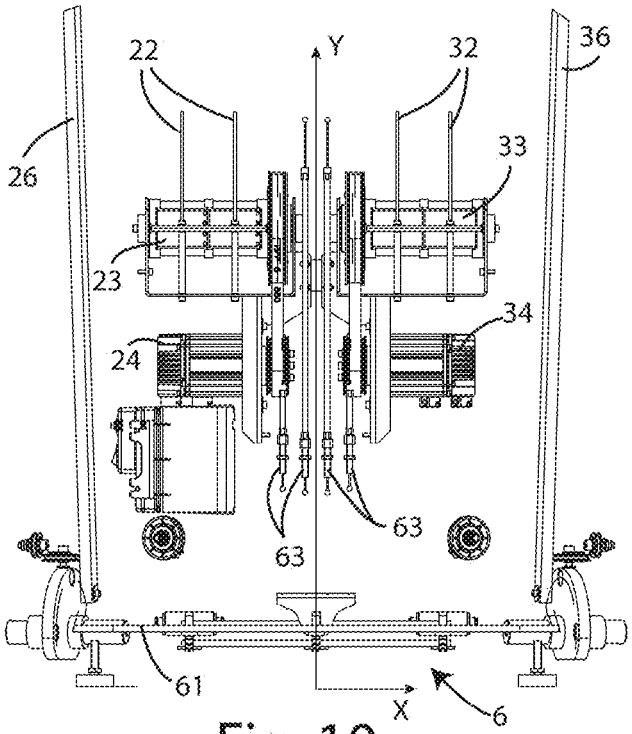
FIG. 10 shows a front view of a detail of FIG. 7.

Referring to FIGS. 6 and 10, the exercise machine M may further comprise a locking/unlocking device 6 of the first pair of arms 21 and of the second pair of arms 31. In particular, the locking/unlocking device 6 in turn comprises at least one pedal 61, a plurality of pins 62 and a plurality of cables 63.

Each pin of said plurality of pins 62 is arranged in correspondence with a respective arm of said first pair of arms 21 and of said second pair of arms 31.

In particular, a first pin of said plurality of pins 62 is arranged in correspondence of the coupling portion between said upper arm 211 and said frame 1.

A second pin of said plurality of pins 62 is arranged in correspondence of the coupling portion between said lower arm 212 and said frame 1.

Similarly, two pins of said plurality of pins 62 are arranged in correspondence of the coupling portions between said second pair of arms 31 and said frame 1.

Each pin of said plurality of pins 62 is configured to lock the respective arm of said first pair of arms 21 or said second pair of arms 31 in the use position or the rest position.

Two seats are obtained in the coupling portion of each arm of said first pair of arms 21 and of said second pair of arms 31 with said frame 1, for housing the respective pin of said plurality of pins 62 in the use position and in the rest position.

Each pin of said plurality of pins 62 is slidingly coupled to the frame 1, so as to be capable of changing from an engagement position, wherein it occupies a seat of the respective arm, to a disengagement position, wherein it allows the respective arm to change from said use position to said rest position and vice versa.

Each pin of said plurality of pins 62 is maintained in said engagement position by an elastic element, such as for example a spring.

Each cable of said plurality of cables 63 is connected to said pedal 61 and to a respective pin of said plurality of pins 62 and slides inside a respective sheath.

Said pedal 61 is configured to operate the cables of said plurality of cables 63 in order to change the pins of said plurality of pins 62 from the engagement position to the disengagement position.

It is also possible that said locking/unlocking device 6 comprises a first pedal and a second pedal. In this case, said first pedal is connected to the pins of said first pair of arms 21 and said second pedal is connected to the pins of said second pair of arms 31.

Said exercise machine M also comprises a detection device 7, connected to the logic control unit 5, capable of detecting the position of said first pair of arms 21 and of said second pair of arms 31.

In particular, said detection device 7 comprises a first detection sensor 71 and a second detection sensor 72.

Said first detection sensor 71 is arranged in the proximity of said coupling portion between said upper arm 211 and said frame 1, or in proximity of said coupling portion between said lower arm 212 and said frame 1.

The first detection sensor 71 is configured to detect the position of said first pair of arms 21. In particular, said first detection sensor 71 is capable of detecting whether said first pair of arms 21 is in the use position, in the rest position or in an intermediate position.

Similarly, said second detection sensor 72 is configured to detect the position of said second pair of arms 31.

Said first detection sensor 71 and said second detection sensor 72 may be for example switches, placed in correspondence of said pins 62, to detect the movement and/or the position of the pins 62 themselves.

Furthermore, said first sensor 71 and said second sensor 72 may be magnetic or Hall effect or optical sensors, or cameras.

Said logic control unit 5 is configured to receive data from said first detection sensor 71 and said second detection sensor 72, to determine the position of said first pair of arms 21 and said second pair of arms 31.

The logic control unit 5 is also configured to control said first actuator 24 and said second actuator 34 on the basis of the position of said first pair of arms 21 and said second pair of arms 31, respectively.

In particular, in said first configuration of said exercise machine M, the logic control unit 5 can control said first actuator 24 and said second actuator 34 in synchronous mode, i.e. identically, or in independent mode, i.e. in a different way.

Said logic control unit 5 comprises a data communication module of the wireless type, for example of the Bluetooth® or Wi-Fi or NFC or Ant+ type. Said logic control unit 5 comprises a memory that stores specific computer-executable instructions for the functions discussed herein. Said logic control unit 5 comprises a hardware processor in communication with the memory for the hardware processor to execute the specific computer-executable instructions for the functions discussed herein.

Said data communication module is capable of sending and receiving data from remote devices D, such as a smartphone, smartwatch, tablet, or cloud unit.

The logic control unit 5 is connected to the first actuator 24 and the second actuator 34, to independently control the drive or resistant torque that said first actuator 24 and said second actuator 34 exert on the first cable 22 and second cable 32, respectively.

The drive or resistant torque of the first actuator 24 and second actuator 34 exerted respectively on the first cable 22 and second cable 32 can be adjusted independently of the logic control unit 5, so as to obtain different types of resistant load while the user is performing exercises.

Furthermore, the value of the drive or resistant torque of the first actuator 24 and second actuator 34 can be varied while performing the gymnastic exercise, so as to simulate a resistance having different characteristics, such as for example of the gravitational, elastic, viscous, isotonic, isokinetic type and the like.

Said exercise machine M also comprises at least one positioning device 8, capable of detecting the position and/or movement of the user in the proximity of the exercise machine M, while performing the gymnastic exercise and also the characteristic metrics of the gymnastic exercise.

In a first embodiment, said detection device 8 is arranged on said frame 1 of said exercise machine M and is connected to the logic control unit 5.

Said detecting device is a sensor such as a camera or video camera.

In a second embodiment, said at least one positioning device 8' is arranged on said first actuator 24 and/or second actuator 34, to detect the winding and/or unwinding status, relative to an initial reference position, of said first cable 22 and said second cable 32, respectively, and is connected to the logic control unit 5.

In particular, said positioning device 8' detects information concerning the rotational position of said first actuator 24 and said second actuator 34 themselves, which makes it possible to determine the length of said first cable 22 and said second cable 32 which has been unrolled by the user. The unrolled length of cable in turn makes it possible to obtain the user's position in each step of the gymnastic exercise performance, and also the position of said at least one first handle 25 along said first cable 22 and of said at least one second handle 35 along said second cable 32.

In particular, said positioning device 8' is an angular position transducer, or encoder, of the magnetic, capacitive or inductive, potentiometric or optical type.

In a third embodiment, said positioning device 8" comprises both the positioning device 8, according to the first embodiment, and the positioning device 8', according to the second embodiment.

The logic control unit 5 is capable of receiving the data detected by said positioning device 8, 8' and 8", and is capable of providing a response or feedback to the user, when he/she is in a correct position to perform an exercise, in particular, when said first cable 22 and said second cable 32 have reached said correct position, or when the user is in a correct position in the proximity of said exercise machine M.

Said response can be of the tactile type on said first handle 25 and said second handle 35, of the acoustic type or of the visual type. Said response can also be sent to said remote devices D.

This response can provide information concerning the performance parameters of an exercise, such as for example speed, acceleration, movement range, number of repetitions and number of series performed.

Figure 11:
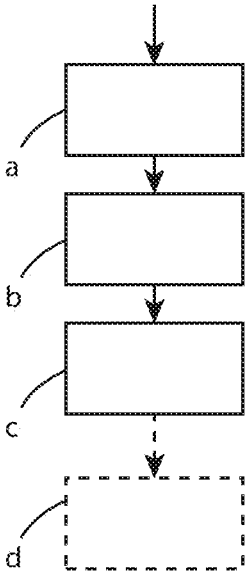
FIG. 11 shows a block diagram of the method for operating the exercise machine, object of the disclosure.

Referring to FIG. 11, the logic control unit 5 can store local training programmes, or even receive training programmes from said remote devices D.

The interface device 4 is connected to the logic control unit 5 and is capable of receiving input signals for selecting a training programme and/or a desired resistance to the gymnastic exercise.

The interface device 4 may include a touchscreen, one or more speakers, to provide responses to the user.

Said interface device 4 may comprise a plurality of sensors, such as for example one or more cameras 41, for detecting the movements and position of one or more users positioned in front of said exercise machine M, the type and weight of any separate exercise equipment used by the user.

Said camera 41 can also be capable of detecting the position of said first pair of arms 21 and said second pair of arms 31, to send corresponding data to the logic control unit 5, which is capable of determining in which configuration the exercise machine M is.

The interface device 4 also shows the user information and data concerning the gymnastic exercise performance.

In particular, on the basis of the detected configuration, it is possible to show audio and/or video multimedia content and data tracking concerning a bodyweight or free-weights gymnastic exercise in the second configuration, or multimedia content and exercise data tracking concerning a workout using one or both of the exercise devices in the first or third configuration.

It is also possible that the interface device 4 enables the display of two separate sections, when said first exercise device 2 and said second exercise device 3 are used by two different users, so as to provide distinct information to the two users to guide the performance of their respective gymnastic exercises.

Said exercise machine M can include further speakers arranged in the lower portion of the frame 1.

With reference to FIG. 6, said exercise machine M is arranged in said third configuration. In particular, the first pair of arms 21 is in the rest position and the second pair of arms 31 is in the use position.

The exercise machine M described above operates as follows.

When a user wants to perform a gymnastic exercise, he/she accesses the exercise machine M.

In particular, the user can choose to use the first exercise device 2 and/or the second exercise device 3.

The user can activate said exercise machine M by pressing an on/off button.

Said exercise machine M can also automatically switch from a stand-by state to an active state and vice versa.

In this case, the user, by moving said first pair of arms 21 and/or said second pair of arms 31 or by operating said locking/unlocking device 6, causes the switch of said exercise machine from the stand-by state to the active state.

In particular, when the user moves said first pair of arms 21 and/or said second pair of arms 31, said detecting device 7 detects the movement and/or position of said first pair of arms 21 and said second pair of arms 31 and sends a signal to the logic control unit 5 to activate the exercise machine M.

If the user intends to use the first pair of arms 21 and second pair of arms 31, he/she changes each pair of arms from the rest position to the use position.

In particular, the user operates said pedal 61. Said pedal 61 in turn operates the cables of said plurality of cables 63 to change the pins of said plurality of pins 62 from the engagement position to the disengagement position.

The user then changes said first pair of arms 21 and said second pair of arms 31 from the rest position to the use position and releases said pedal 61.

The pins of said plurality of pins 62 then return to said engagement position, locking said first pair of arms 21 and said second pair of arms 31 in the use position. The exercise machine M is therefore in the first configuration.

In the case that said locking/unlocking device 6 comprises a first pedal and a second pedal, the user operates said first pedal to change said first pair of arms 21 from the rest position to the use position, and operates said second pedal to change said second pair of arms 31 from the rest position to the use position.

Said detection device 7 detects the position of said first pair of arms 21 and said second pair of arms 31 and sends corresponding data to the logic control unit 5.

In particular, said first detection sensor 71 detects the position of said first pair of arms 21, while said second detection sensor 72 detects the position of said second pair of arms 31.

The logic control unit 5 receives said data and processes them, to obtain the position assumed by said first pair of arms 21 and said second pair of arms 31.

If the logic control unit 5 detects that said first pair of arms 21 and said second pair of arms 31 are changing from the rest position to the use position, it controls said first actuator 24 and said second actuator 34 to allow said first cable 22 and second cable 32 to unroll and stretch out freely.

When the logic control unit 5 detects that said first pair of arms 21 and second pair of arms 31 have reached the use position, both said first actuator 24 and said second actuator 34 are operated to perform a gymnastic exercise, as better described below.

The user chooses a training programme and/or a desired resistance to the gymnastic exercise via the interface device, or via a remote device D connected to said logic control unit 5.

It is also possible that said logic control unit 5 receives the preset training programme in the form of multimedia content, such as for example the video or audio of a workout performed by a coach or trainer, coming from a remote device D or a server or the cloud.

Said multimedia content may contain control and/or command signals for said first actuator 24 and said second actuator 34, according to the training programme to be performed.

The user may also select resistances to the exercise which are different on said first exercise device 2 and said second exercise device 3, both in intensity and type, choosing for example a resistance of the gravitational, isometric, isokinetic, viscous or elastic type.

The user then grabs said first handle 25 and/or said second handle 35 and performs the selected gymnastic exercise.

It is also possible to configure said logic control unit 5 so that two distinct users perform distinct gymnastic exercises and/or with different resistances to the exercise.

In this case, a first user uses said first handle 25 on said first cable 22, while a second user uses said second handle 35 on said second cable 32. The logic control unit 5 is configured to independently control said first actuator 24 and said second actuator 34, so that they generate different loads for the first user and for the second user, in accordance with the preset training programmes or on the basis of a manual selection by the first user and the second user via said interface device 4.

In this case, the logic control unit 5 controls the screen of said interface device 4, so that it is divided into two separate sections, to show each user the information concerning the performance of the respective gymnastic exercise through their respective exercise device.

The gymnastic exercise performed by the user consists of a concentric phase and an eccentric phase.

In particular, during the concentric phase, the user's muscle contraction generates a drive force.

Said drive force causes said first handle 25 and/or said second handle 35 to move away, which in turn causes the unrolling of the respective cable from the corresponding winding drum. The respective actuator then exerts an action resistant to the muscle contraction.

In particular, after having selected the resistant load, the logic control unit 5 adjusts said first actuator 24 and/or said second actuator 34 so as to obtain the selected resistant load.

In this case, the actuator generates a surplus of electricity which is dissipated on an external resistance. In this way, the actuator generates a resistance to the movement and therefore acts as a brake.

During the eccentric phase, the muscle performing the exercise stretches out and acts as a resistance for the actuator, generating a drive force.

In this case, the actuator acts as an electric motor and absorbs electricity from the mains, producing a drive torque.

Said first actuator 24 and said second actuator 34 will therefore have different operating modes in the two phases described above.

During the performance of the gymnastic exercises, said positioning device 8, 8', 8" detects the position of the user and/or the position of said first cable 22 and/or said second cable 32, to then send the data to the logic control unit 5.

The logic control unit 5 receives said data and determines the user's position in each phase of the gymnastic exercise performance.

The logic control unit 5 compares the position and movements of the user received from said positioning device 8, 8', 8" with stored position and movement reference parameters to provide the user with information on the correct performance of the exercise.

Said information are provided in the form of a response or feedback to the user regarding parameters for performing an exercise, such as for example speed, resistant load and movement range.

When the user ends to perform the gymnastic exercise, he/she releases the first handle 25 and/or second handle 35.

Alternatively, the user can choose to use only said first exercise device 2 or said second exercise device 3 by arranging said exercise machine M in said third configuration.

In this case, the user arranges said first pair of arms 21 in said use position and said second pair of arms 31 in said rest position, or vice versa.

The detection device 7 detects the position of said first pair of arms 21 and said second pair of arms 31 and sends corresponding data to the logic control unit 5.

The logic control unit 5 receives said data, deactivates the actuator of the pair of arms arranged in the rest position and controls only the actuator of the pair of arms in the use position. The interface device 4 therefore shows only information concerning the exercise device in use.

When not in use, said exercise machine M can be arranged in the second configuration. In particular, the user changes said first pair of arms 21 and said second pair of arms 31 from the use position to the rest position.

The user presses said pedal 61, which by means of said disengagement cables 63 changes said plurality of pins from the engagement position to the disengagement position.

Said detection device 7 detects the change of the first pair of arms 21 and second pair of arms 31 from the use position to the rest position and sends a corresponding signal to the logic control unit 5.

The logic control unit 5 then controls the first actuator 24 and second actuator 34 to wind said first cable 22 and said second cable 32, so as to assist the user and facilitate the change of position.

A first advantage of some embodiments of the disclosure is the opportunity of having an exercise machine wherein the resistance to the gymnastic exercise performance is variable while using it.

A further advantage of some embodiments of the disclosure is the opportunity of having an exercise machine wherein the resistance exerted on the two cables is mutually independent.

The present disclosure has been described for illustrative, but not limitative purposes, according to its preferred embodiments, but it is to be understood that changes and/or modifications can be introduced by those skilled in the art without thereby departing from its scope of protection, as defined by the enclosed claims.

What is claimed is:

1. An exercise machine for performing a gymnastic exercise, the exercise machine comprising:

a first exercise device comprising:

at least one first cable;

at least one first handle, coupled to said first cable, to allow a first user to perform a first gymnastic exercise; and a first pair of arms, to support said first cable; and a second exercise device comprising:

at least one second cable;

at least one second handle, coupled to said second cable, to allow a second user to perform a second gymnastic exercise; and a second pair of arms, to support said second cable:

a first actuator, connected to said first cable, to exert a drive or resistant torque on said first cable;

a second actuator, connected to said second cable, to exert a drive or resistant torque on said second cable;

a logic control unit, connected to said first actuator and said second actuator, for independently adjusting said drive or resistant torque exerted by each of the first and second actuators; and a detector configured to detect a position of said first pair of arms and said second pair of arms and provide position data to the logic control unit;

wherein the logic control unit is configured to independently control said first actuator and said second actuator for the first actuator and the second actuator to generate different loads for the first user and for the second user, respectively, in accordance with independently selectable preset training programs or based on a manual selection by the first user and the second user via an interface device, thereby enabling simultaneous and independent gymnastic exercises;

wherein said first pair of arms and said second pair of arms are configured to change independently from a use position in which the first and second users are allowed to perform the first and second gymnastic exercises to a rest position in which the first and second users are not allowed to perform the first and second gymnastic exercises;

wherein the logic control unit is configured to, based on the position data received from the detector:

activate the first actuator and deactivate the second actuator responsive to the position data indicating that the first pair of arms is in the use position and the second pair of arms is in the rest position; and activate the second actuator and deactivate the first actuator responsive to the position data indicating that the second pair of arms is in the use position and the first pair of arms is in the rest position.

2. The exercise machine according to claim 1, further comprising a positioning device connected to said logic control unit, the positioning device capable of detecting a positioning of the first user and the second user in proximity of said exercise machine and/or detecting winding/unwinding of said first cable and said second cable and sending corresponding data to said logic control unit.

3. The exercise machine according to claim 2, wherein said positioning device is connected to said first actuator and/or said second actuator, to detect the winding and/or unwinding status, relative to an initial reference position, of said first cable and said second cable, respectively.

4. The exercise machine according to claim 3, wherein said positioning device is an angular position transducer, or encoder, of magnetic, capacitive or inductive, potentiometric or optical, type.

5. The exercise machine according to claim 2, wherein said positioning device is arranged on a frame to detect a position and/or a movement of the first and the second users in the proximity of the exercise machine, while performing the gymnastic exercise.

6. The exercise machine according to claim 2, wherein said positioning device is arranged on a frame.

7. The exercise machine according to claim 2, wherein the positioning device further comprises at least one camera to detect movements of the first and the second users while performing the gymnastic exercise.

8. The exercise machine according to claim 1, further comprising a locking/unlocking device, for locking said first pair of arms and said second pair of arms in said use position and/or said rest position.

9. The exercise machine according to claim 8, wherein said locking/unlocking device comprises:

a pedal, to allow the change of said first pair of arms and said second pair of arms from said use position to said rest position and vice versa; and a plurality of pins, to lock said first pair of arms and said second pair of arms in said use position and said rest position.

10. A method for operating an exercise machine according to claim 1, the method comprising the following steps:

a. receiving data concerning a configuration of said exercise machine;

b. processing said data received in said step a. for determining the configuration of said exercise machine; and c. activating or deactivating, on a basis of said data processed in said step b., said first actuator of said first exercise device and/or said second actuator of said second exercise device.

11. The method according to claim 10, further comprising the following step:

d. displaying information concerning the performance of a gymnastic exercise with said first exercise device and/or said second exercise device, activated in said step c.

12. The exercise machine according to claim 1, further comprising:

a first winding drum, connected to said first actuator, and on which said first cable is wound; and a second winding drum, connected to said second actuator, and on which said second cable is wound.

13. The exercise machine according to claim 1, wherein one or more gymnastic exercises are stored in said logic control unit.

14. The exercise machine according to claim 1, further comprising the interface device, connected to said logic control unit, for displaying information concerning the gymnastic exercise performed by the first and second users.

15. The exercise machine according to claim 1, further comprising:

a first section, for displaying data concerning the gymnastic exercise performed using said first exercise device; and a second section, for displaying data concerning the gymnastic exercise performed using said second exercise device.

16. The exercise machine according to claim 1, wherein said logic control unit is configured to receive data from a positioning device and is further configured to provide the first and the second users with a response of visual, audio or tactile type, corresponding to said data.

17. The exercise machine according to claim 1, wherein said logic control unit comprises a connection unit for being connectable to remote devices including smartphones, tablets or cloud, from which it receives parameters concerning gymnastic exercises and/or training programmes.

18. The exercise machine according to claim 1, wherein:

said exercise machine has reduced overall dimensions when at least one of said first pair of arms or said second pair of arms is in the rest position.

19. The exercise machine according to claim 1, wherein;

said first exercise device comprises a coupling mechanism, said first pair of arms comprises an upper arm and a lower arm, coupled together by said coupling mechanism, to be in stable equilibrium in any position they can assume between said use position and said rest position, said second exercise device comprises a second coupling mechanism, and said second pair of arms comprises a second upper arm and a second lower arm, coupled together by means of said second coupling mechanism, to be in stable equilibrium in any position they can assume between said use position and said rest position.

20. The exercise machine according to claim 1, further comprising the interface device configured to:

output information related to the first exercise device but not the second exercise device responsive to the position data indicating that the first pair of arms is in the use position and the second pair of arms is in the rest position; and output information related to the second exercise device but not the first exercise device responsive to the position data indicating that the second pair of arms is in the use position and the first pair of arms is in the rest position.

* * * * *